US005735112A

United States Patent [19]

Naito et al.

[11] Patent Number: 5,735,112

[45] Date of Patent: Apr. 7, 1998

[54] YARN HEATING APPARATUS

[75] Inventors: Syunzo Naito, Matsuyama; Setsuo Nakamura, Tokyo, both of Japan

[73] Assignee: Teijin Seiki Co., Ltd., Osaka, Japan

[21] Appl. No.: 827,591

[22] Filed: Mar. 28, 1997

[51] Int. Cl.[6] ..... D01H 7/46; D01H 7/92

[52] U.S. Cl. ..... 57/290; 28/249; 57/284; 57/352

[58] Field of Search ..... 57/284, 290, 352; 28/249; 34/68, 164, 624, 628, 647; 219/388

[56] References Cited

U.S. PATENT DOCUMENTS

| | | | |
|---|---|---|---|
| 5,138,829 | 8/1992 | Tanae et al. | 57/288 |
| 5,148,666 | 9/1992 | Bauer et al. | 57/290 |
| 5,353,583 | 10/1994 | Tanae et al. | 57/288 |
| 5,404,705 | 4/1995 | Yanagihara et al. | 57/290 |
| 5,438,820 | 8/1995 | Nakahara et al. | 57/290 |
| 5,528,893 | 6/1996 | Yanagihara et al. | 57/290 |

*Primary Examiner*—William Stryjewski
*Attorney, Agent, or Firm*—Lane, Aitken & McCann

[57] ABSTRACT

A yarn heating apparatus, interposed between a false twist apparatus imparting twist to a synthetic fiber yarn and a yarn feed apparatus feeding the synthetic fiber yarn to the false twist apparatus, is designed to heat the synthetic fiber yarn traveling on a yarn travel path extending from the yarn feed apparatus to the false twist apparatus. The yarn travel path includes a twist existence path section through which the twist imparted to the synthetic fiber yarn extends continuously. The yarn heating apparatus comprises a yarn heat member unit formed with a yarn heat channel defining in part the twist existence path section of the yarn travel path for heating the synthetic fiber yarn passing through the yarn heat channel, and a plurality of yarn guide members located in the yarn heat channel of the yarn heat member unit in spaced relationship to one another for guiding the synthetic fiber yarn through the yarn heat channel of the yarn heat member unit. The synthetic fiber yarn in the yarn heat channel is bent by each of the yarn guide members and has a plurality of contact surface portions each brought into contact with each of the yarn guide members. The contact surface portions of the synthetic fiber yarn have lengths, respectively, measured along the yarn travel path. The lengths of the contact surface portions of the synthetic fiber yarn amount to a total contact length which is not less than 4 mm and not more than 20 mm.

3 Claims, 6 Drawing Sheets

YARN HEATING APPARATUS

BACKGROUND OF THE INVENTION

1. Field of the Invention

The present invention relates to a yarn heating apparatus adapted for use in a false twisting machine or a drawing and false twisting machine and, more particularly, to a yarn heating apparatus which is interposed between a false twist apparatus imparting twist to a synthetic fiber yarn and a yarn feed apparatus feeding the synthetic fiber yarn to the false twist apparatus and which is designed to heat the synthetic fiber yarn traveling on a yarn travel path including a twist existence path section through which the twist imparted by the false twist apparatus to the synthetic fiber yarn extends continuously. The synthetic fiber yarn is heated by the yarn heating apparatus within the twist existence path section of the yarn travel path.

2. Description of the Related Art

There have so far been proposed various types of false twisting machines or drawing and false twisting machines used for processing a synthetic fiber yarn constituted by a plurality of filaments. Such a false twisting machine or a drawing and false twisting machine comprises a yarn false twist apparatus for imparting twist to a synthetic fiber yarn, a yarn feed apparatus for feeding the synthetic fiber yarn to the yarn false twist apparatus, and a yarn heating apparatus interposed between the yarn false twist apparatus and the yarn feed apparatus for heating the synthetic fiber yarn traveling on a yarn travel path that extends from the yarn feed apparatus to the yarn false twist apparatus, i.e., that is positioned on the upstream side of the yarn false twist apparatus. The yarn travel path includes a twist existence path section through which the twist imparted to the synthetic fiber yarn extends continuously and within which the synthetic fiber yarn is heated. The yarn heating apparatus comprises one or more yarn heat members for producing heat energy to be applied to the synthetic fiber yarn. The yarn heat member is designed to heat, without contact, the synthetic fiber yarn with the intention of facilitating an increase in the processing speed of the synthetic fiber yarn. More specifically, the yarn heat member is formed with a yarn heat channel defining in part the twist existence path section of the yarn travel path between the yarn feed apparatus and the yarn false twist apparatus. While the synthetic fiber yarn passes through the yarn heat channel of the yarn heat member, the synthetic fiber yarn is heated by the yarn heat member. The yarn heating apparatus further comprises a plurality of yarn guide members located in the yarn heat channel of the yarn heat member in spaced relationship to one another for guiding the synthetic fiber yarn through the yarn heat channel of the yarn heat member.

Such a yarn heating apparatus for heating the synthetic fiber yarn is disclosed in, for example, U.S. Pat. No. 5,148,666 as comprising a yarn heat member formed with a yarn heat channel and a plurality of yarn guide members located in the yarn heat channel of the yarn heat member. Each of the yarn guide members is formed with a slit which has an open end allowing the synthetic fiber yarn to enter and escape from the slit. When the synthetic fiber yarn advances in the yarn heat channel of the yarn heat member, the synthetic fiber yarn is caused to pass through the slits of the yarn guide members and guided by the yarn guide members. For instance, the slits of the yarn guide members extend along a straight line in the depth direction of the yarn heat channel and respectively have closed ends spaced apart from the bottom wall portion of the yarn heat channel at the same distance. In addition, the slits of the yarn guide members are deflected from the center line in a cross section of the yarn heat channel. More specifically, adjoining two of the yarn guide members have their own slits deflected from the center line of the yarn heat channel in the opposite directions, respectively, parallel to the width direction of the yarn heat channel. When the synthetic fiber yarn passes through the yarn heat channel of the yarn heat member, the synthetic fiber yarn is bent by one side wall portions of the slits of the yarn guide members. This mean that the synthetic fiber yarn in the yarn heat channel has a plurality of bend portions the number of which is equal to that of the yarn guide members and accordingly advances along a zigzag line in parallel relationship to the surface of the bottom wall portion of the yarn heat channel. If the yarn heating apparatus is so constructed as to cause the synthetic fiber yarn to advance along the zigzag line, there is a possibility that the synthetic fiber yarn in the yarn heat channel of the yarn heat member is prevented from having harmful vibration such as a phenomenon called as ballooning under the condition that the synthetic fiber yarn advances at a relatively low speed level within a speed range generally considered as high.

In the meantime, another yarn heating apparatus for heating the synthetic fiber yarn is disclosed in Japanese Patent Laid-open Publication No. 6-49724 or Japanese Utility Model Laid-open Publication No. 59-73378 as comprising a yarn heat member formed with a yarn heat channel and a plurality of yarn guide members located in the yarn heat channel and each formed with a V-shaped recess portion which allows the synthetic fiber yarn to pass therethrough. The V-shaped recess portions of the yarn guide members respectively have bottom wall portions brought into contact with the synthetic fiber yarn and respectively have different depths. The depth of the V-shaped recess portion of the yarn guide member becomes larger as the yarn guide member is more remote from the center point of the yarn heat member. This results in the fact that the synthetic fiber yarn travels on the yarn travel path extending along an arched line in an imaginary plane parallel to the depth direction of the yarn heat channel. If the yarn heating apparatus is so constructed as to cause the synthetic fiber yarn to advance along the curved line, the yarn heating apparatus has the same advantage as the foregoing apparatus does. Namely, there is a possibility that the synthetic fiber yarn in the yarn heat channel of the yarn heat member is prevented from having harmful vibration such as a phenomenon called as ballooning under the condition that the synthetic fiber yarn advances at a relatively low speed level within a speed range generally considered as high.

A drawback is, however, encountered in prior-art yarn heating apparatus of the above described nature in that the synthetic fiber yarn has the harmful vibration if the synthetic fiber yarn is intended to advance at a speed higher than a certain speed level. Due to the harmful vibration, the heating efficiency of the yarn heating apparatus is irregularly varied and, accordingly, the temperature of the synthetic fiber yarn in the yarn heat channel is uncontrollably varied. This means that, making the assumption that the synthetic fiber yarn twisted under the heating condition forms a yarn package on a spindle, the yarn package has dyeing property lacking in uniformity. If, furthermore, the synthetic fiber yarn twisted under the heating condition forms a plurality of yarn packages on spindles, the yarn packages are different in dyeing property from one another. In addition, there occurs distinctly a surging phenomenon on the synthetic fiber yarn in the twist existence path section of the yarn travel path if the advancing speed of the synthetic fiber yarn is increased so as to exceed a level of 1000 meters per minute. If the surging phenomenon occurs on the synthetic fiber yarn in the twist existence path section of the yarn travel path, the tension of the synthetic fiber yarn is extremely varied. In this case, it is difficult for the false twisting machine or the drawing and false twisting machine to increase its own processing speed to a relatively high speed level.

Possibly, the yarn guide members could be aligned at space regular intervals which are respectively smaller than those of the above-mentioned prior-art yarn heating apparatus with the intention of reducing the harmful vibration of the synthetic fiber yarn. In addition, the contact pressure caused between the synthetic fiber yarn and each of the yarn guide members could be increased to a certain level higher than that of the described prior-art yarn heating apparatus with the same intention. If, however, the yarn heating apparatus is thus constructed, the yarn guide members are liable to fluff the synthetic fiber yarn. As a consequence, the synthetic fiber yarn is decreased in quality.

SUMMARY OF THE INVENTION

It is an object of the present invention to provide a yarn heating apparatus which ensures that the harmful vibration is prevented from occurring on the synthetic fiber yarn advancing at high speed in the twist existence path section of the yarn travel path by improving a manner in which the yarn guide members are brought into contact with the synthetic fiber yarn.

It is another object of the present invention to provide a yarn heating apparatus which ensures that a yarn package formed by the twisted and heated synthetic fiber yarn is excellent in dyeing property and that a plurality of yarn packages formed by the synthetic fiber yarn twisted and heated under the same condition are substantially equal in dyeing property to one another.

In accordance with one aspect of the present invention, there is provided a yarn heating apparatus, interposed between a false twist apparatus imparting twist to a synthetic fiber yarn and a yarn feed apparatus feeding the synthetic fiber yarn to the false twist apparatus, for heating the synthetic fiber yarn traveling on a yarn travel path extending from the yarn feed apparatus to the false twist apparatus. The yarn travel path includes a twist existence path section through which the twist imparted to the synthetic fiber yarn extends continuously. The yarn heating apparatus comprises a yarn heat member unit formed with a yarn heat channel defining in part the twist existence path section of the yarn travel path for heating the synthetic fiber yarn passing through the yarn heat channel, and a plurality of yarn guide members located in the yarn heat channel of the yarn heat member unit in spaced relationship to one another for guiding the synthetic fiber yarn through the yarn heat channel of the yarn heat member unit. The synthetic fiber yarn in the yarn heat channel is bent by each of the yarn guide members and has a plurality of contact surface portions each brought into contact with each of the yarn guide members. The contact surface portions of the synthetic fiber yarn have lengths, respectively, measured along the yarn travel path. The lengths of the contact surface portions of the synthetic fiber yarn amount to a total contact length which is not less than 4 mm and not more than 20 mm. When the yarn travel path is projected on an imaginary plane parallel to the depth direction of the yarn heat channel of the yarn heat member, the yarn travel path of the synthetic fiber yarn may be shown in the imaginary plane as extending along an arched line. When, on the other hand, the yarn travel path is projected on an imaginary plane parallel to the width direction of the yarn heat channel of the yarn heat member, the yarn travel path of the synthetic fiber yarn may be shown in the imaginary plane as extending along a zigzag line.

In accordance with another aspect of the present invention, there is provided a yarn heating apparatus, interposed between a false twist apparatus imparting twist to a synthetic fiber yarn and a yarn feed apparatus feeding the synthetic fiber yarn to the false twist apparatus, for heating the synthetic fiber yarn traveling on a yarn travel path extending from the yarn feed apparatus to the false twist apparatus. The yarn travel path includes a twist existence path section through which the twist imparted to the synthetic fiber yarn extends continuously. The yarn heating apparatus comprises a yarn heat member formed with a yarn heat channel defining in part the twist existence path section of the yarn travel path for heating the synthetic fiber yarn passing through the yarn heat channel, and a plurality of yarn guide members located in the yarn heat channel of the yarn heat member in spaced relationship to one another for guiding the synthetic fiber yarn through the yarn heat channel of the yarn heat member. The yarn guide members are classified into two groups consisting of a first guide member group formed by the yarn guide members which prevent the synthetic fiber yarn from vibrating in a width direction of the yarn heat channel of the yarn heat member, and a second guide member group formed by the yarn guide members which prevent the synthetic fiber yarn from vibrating in a depth direction of the yarn heat channel of the yarn heat member. Each of the yarn guide members of the first guide member group may be formed with a straight slit extending straight in the depth direction of the yarn heat channel of the yarn heat member and having an open end which allows the synthetic fiber yarn to enter and escape from the straight slit. Each of the yarn guide members of the second guide member group may be formed with a hook-shaped slit and having an open end which allows the synthetic fiber yarn to enter and escape from the hook-shaped slit. The yarn guide members of the first guide member group and the yarn guide members of the second guide member group may be alternately aligned in the yarn heat channel of the yarn heat member. The yarn guide members of the second guide member group may have their own closed ends of the hook-shaped slits directed to the same side wall portion of the yarn heat channel of the yarn heat member.

In accordance with a further aspect of the present invention, there is provided a yarn heating apparatus, interposed between a false twist apparatus imparting twist to a synthetic fiber yarn and a yarn feed apparatus feeding the synthetic fiber yarn to the false twist apparatus, for heating the synthetic fiber yarn traveling on a yarn travel path extending from the yarn feed apparatus to the false twist apparatus. The yarn travel path includes a twist existence path section through which the twist imparted to the synthetic fiber yarn extends continuously. The yarn heating apparatus comprises a first yarn heat member formed with a yarn heat channel defining in part the twist existence path section of the yarn travel path for heating the synthetic fiber yarn passing through the yarn heat channel of the first yarn heat member; and a plurality of first yarn guide members aligned at space intervals in the yarn heat channel of the first yarn heat member for guiding the synthetic fiber yarn through the yarn heat channel of the first yarn heat member. The yarn heating apparatus further comprises a second yarn heat member formed with a yarn heat channel defining in part the twist existence path section of the yarn travel path for heating the synthetic fiber yarn passing through the yarn heat channel of the second yarn heat member, and a plurality of second yarn guide members aligned at space intervals in the yarn heat channel of the second yarn heat member for guiding the synthetic fiber yarn through the yarn heat channel of the second yarn heat member. The second yarn heat member is positioned downstream of the first yarn heat member. The second yarn heat member is divided into at least two yarn heat sections aligned along the yarn travel path. The two yarn heat sections consist of a first yarn heat section and a second yarn heat section positioned downstream of the first yarn heat section. The largest one of the space intervals at which the second yarn guide members are aligned in the first yarn heat section is smaller than the smallest one of the space intervals at which the second yarn guide members are aligned in the second yarn heat section. The space interval between adjoining two of the second yarn guide members in the first heat section may become larger as the adjoining two of the second yarn guide members in the first heat section are positioned more downstream. The space interval between adjoining two of the second yarn guide members in the second heat section may become larger as the adjoining two of the second yarn guide members in the second heat section are positioned more downstream.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1(*b*) is a cross sectional view taken on a plane indicated by lines 1(*b*)–1(*b*) of FIG. 1(*a*) for explaining the shape of yarn guide members shown in FIG. 1(*a*);

FIG. 2(*b*) is an enlarged fragmentary cross sectional view taken on a plane parallel to the width direction of the yarn heat channel shown in FIG. 1(*a*) or 1(B);

DESCRIPTION OF THE PREFERRED EMBODIMENTS

Referring to FIGS. 1 to 4 of the drawings, a first preferred embodiment of the yarn heating apparatus according to the present invention will be described hereinlater.

Figure 4:
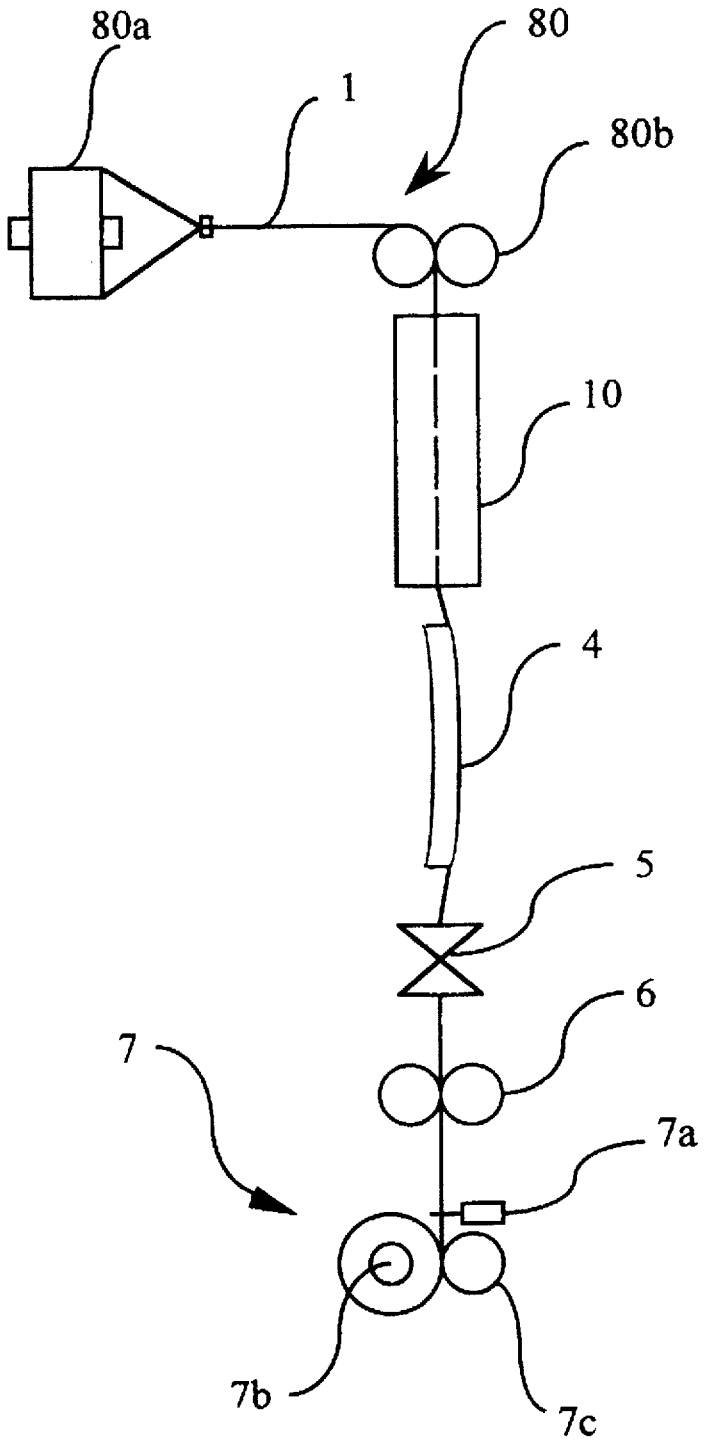
FIG. 4 is a schematic view of a drawing and false twisting machine including the yarn heating apparatus shown in FIGS. 1(*a*) and 1(*b*)

FIG. 4 is a schematic view of a drawing and false twisting machine comprising a yarn false twist apparatus 5 for imparting twist to a synthetic fiber yarn 1, a yarn feed apparatus 80 for feeding the synthetic fiber yarn 1 to the yarn false twist apparatus 5, and a yarn heating apparatus 10 interposed between the yarn false twist apparatus 5 and the yarn feed apparatus 80. The synthetic fiber yarn 1 is constituted by, for example, polyester or polyamide fibers. The yarn feed apparatus 80 comprises a supply package 80*a* and first feed rollers 80*b*. The drawing and false twisting machine further comprises a stabilizing track 4, second feed rollers 6 and a take up device 7. The synthetic fiber yarn 1 is withdrawn from the supply package 80*a* by means of the first feed rollers 80*b*. The withdrawn synthetic fiber yarn 1 is drawn at a predetermined draw ratio between the first feed rollers 80*b* and the second feed rollers 6 and, at the same time, the twist is imparted to the synthetic fiber yarn 1 by the yarn false twist apparatus 5 such as friction belts, friction disks or a false twisting spindle. The false twisting operation is carried out simultaneously with the drawing operation but, if desired, the false twisting operation may be performed after the drawing operation.

The twist imparted to the synthetic fiber yarn 1 runs back toward the first feed rollers 80*b* along the synthetic fiber yarn 1. The twist running back along the synthetic fiber yarn 1 is heated by the yarn heating apparatus 10, and then the synthetic fiber yarn 1 is cooled in the stabilizing track 4 positioned immediately downstream of the yarn heating apparatus 10. As described above, between the first feed rollers 80*b* and the second feed rollers 6, the twist is imparted to the synthetic fiber yarn 1 located upstream relative the yarn false twist apparatus 5. After the synthetic fiber yarn 1 passes through the false twist apparatus 5, the synthetic fiber yarn 1 is untwisted. Then, the synthetic fiber yarn 1 is fed to the take up device 7 from the second feed rollers 6. The take up device 7 comprises a traverse device 7*a* for traversing the synthetic fiber yarn 1, a bobbin holder 7*b* onto which a bobbin for winding the synthetic fiber yarn 1 is inserted, and a friction roller 7*c* which is pressed to the bobbin or the yarn layer wound on the bobbin so as to rotate the bobbin. In the present embodiment, a yarn travel path extending from the yarn feed apparatus 80 to the yarn false twist apparatus 5 is considered as to be a path of the synthetic fiber yarn 1 defined between the yarn false twist apparatus 5 and the first feed rollers 80*b*. As will be understood from the foregoing description, the yarn travel path includes a twist existence path section through which the twist imparted by the yarn false twist apparatus 5 to the synthetic fiber yarn 1 extends continuously toward the first feed rollers 80*b*.

Figure 1A:
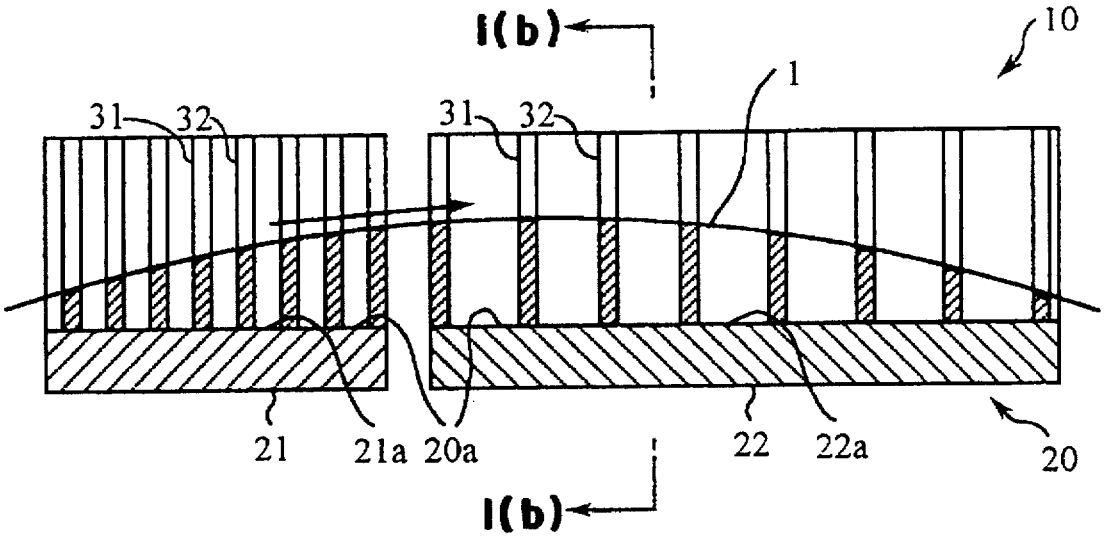
FIG. 1(*a*) is a cross sectional view of a first embodiment of the yarn heating apparatus according to the present invention.
Figure 1B:
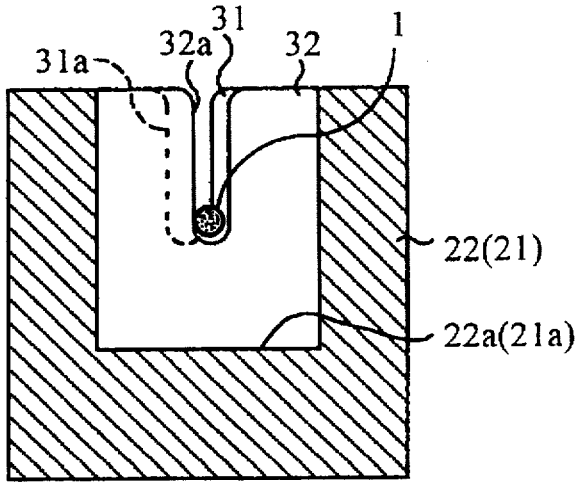

The yarn heating apparatus 10 is shown in FIG. 1(*a*) as comprising a yarn heat member unit 20 formed with a yarn heat channel 20*a* for heating the synthetic fiber yarn 1 passing through the yarn heat channel 20*a*. The yarn heat channel 20*a* of the yarn heat member unit 20 defines in part the twist existence path section of the yarn travel path. More specifically, the yarn heat member unit 20 comprises a first yarn heat member 21 and a second yarn heat member 22 positioned on the downstream side of the first yarn heat member 21. The first yarn heat member 21 is formed with a first yarn heat channel 21*a*, while the second yarn heat member 22 is formed with a second yarn heat channel 22*a*. The yarn heat channel 20*a* of the yarn heat member unit 20 is, therefore, constituted by the first yarn heat channel 21*a* and the second yarn heat channel 22*a*.

The yarn heating apparatus 10 is shown in FIG. 1 as further comprising a plurality of yarn guide members 31 and 32 located in the yarn heat channel 20*a* in spaced relationship to one another. The yarn guide members 31 and 32 serve as means for guiding the synthetic fiber yarn 1 through the yarn heat channel 20*a* of the yarn heat member unit 20. The first yarn heat channel 21*a* of the first yarn heat member 21 has the yarn guide members 31 and 32 alternately aligned therein along the yarn travel path at regular space intervals, while the second yarn heat channel 22*a* of the second yarn heat member 22 has the yarn guide members 31 and 32 alternately aligned therein along the yarn travel path at other regular space intervals. As will be understood from FIG. 1, each of the space intervals at which the yarn guide members 31 and 32 are aligned in the first yarn heat channel 21*a* is smaller than each of the space intervals at which the yarn guide members 31 and 32 are aligned in the second yarn heat channel 22*a*.

As best shown in FIG. 1(*b*), the yarn guide members 31 are formed with straight slits 31*a*, respectively. Each of the straight slits 31*a* of the yarn guide members 31 has an open end and a closed end, and straightly extends from the open end to the closed end along the depth direction of the yarn heat channel 20*a* of the yarn heat member unit 20. Each of the open ends of the straight slits 31*a* allows the synthetic fiber yarn 1 to enter and escape from each of the straight slits 31*a*. Likewise, the yarn guide members 32 are formed with straight slits 32*a*, respectively. Each of the straight slits 32*a* of the yarn guide members 32 has an open end and a closed end, and straightly extends from the open end to the closed end along the depth direction of the yarn heat channel 20*a* of the yarn heat member unit 20. Each of the open ends of the straight slits 32*a* allows the synthetic fiber yarn 1 to enter and escape from each of the straight slits 32*a*.

The straight slit 31*a* of each yarn guide member 31 and the straight slit 32*a* of each yarn guide member 32 are deflected from each other in the width direction of the yarn heat channel 20*a* as will be understood from FIG. 1(*b*). Making the assumption that the yarn travel path of the synthetic fiber yarn 1 is projected upon an imaginary plane that is parallel to the width direction of the yarn heat channel 20*a* of the yarn heat member unit 20, the yarn travel path of the synthetic fiber yarn 1 is shown in the imaginary plane as extending along in a zigzag line because of the fact that the straight slits 31*a* and 32*a* deflected from each other are alternately aligned along the yarn heat channel 20*a* of the yarn heat member unit 20. The straight slits 31*a* and 32*a* of the yarn guide members 31 and 32 respectively have depths which are different from one another. The depth of the straight slit 31*a* or 32*a* becomes larger as the straight slit 31*a* or 32*a* is more remote from the center point of the yarn heat member unit 20 shown in FIG. 1(*a*). Therefore, assuming that yarn travel path of the synthetic fiber yarn 1 is projected upon another imaginary plane that is parallel to the depth direction of the yarn heat channel 20*a* of the yarn heat member unit 20, the yarn travel path of the synthetic fiber yarn 1 is shown in the another imaginary plane as extending along an arched line. FIG. 1(*a*) shows the arched line as the yarn travel path of the synthetic fiber yarn 1.

The false twisting machine or the drawing and false twisting machine is operated to cause the synthetic fiber yarn 1 to enter the straight slits 31*a* and 32*a* of the yarn guide members 31 and 32 and to have a certain tension, so that the synthetic fiber yarn 1 in the yarn heat channel 20*a* of the yarn heat member unit 20 is bent by each of the yarn guide members 31 and 32. As a consequence, the synthetic fiber yarn 1 has a plurality of contact surface portions each brought into contact with each of the wall portions of the straight slits 31*a* and 32*a* of the yarn guide members 31 and 32. The yarn guide members 31 and 32 are, therefore, equal in number to the contact surface portions of the synthetic fiber yarn 1. Although the synthetic fiber yarn 1 is bent by the yarn guide members 31 and 32*a*, the synthetic fiber yarn 1 is kept away from the inside wall portion of the yarn heat channel 20*a* of the yarn heat member unit 20. The wall portions of the straight slits 31*a* and 32*a* brought into contact with the contact surface portions of the synthetic fiber yarn 1 are similar in cross sectional shape to one another. The contact surface portions of the synthetic fiber yarn 1 have lengths, respectively, measured along the yarn travel path of the synthetic fiber yarn 1. The lengths of the contact surface portions of the synthetic fiber yarn 1 amount to a total contact length which is not less than 4 mm and not more than 20 mm.

The yarn travel path of the synthetic fiber yarn 1 is shown in FIGS. 1(*a*), 1(*b*) and described hereinbefore as extending along a zigzag line and an arched line but, if desired, may extends along only one of zigzag and arched lines. In other words, the yarn travel path of the synthetic fiber yarn 1 may be shown in one imaginary plane parallel to the longitudinal axis of the yarn heat channel 20*a* as extending along only one of zigzag and arched lines and shown in all of other imaginary planes as extending along linear lines, respectively.

Figure 2A:
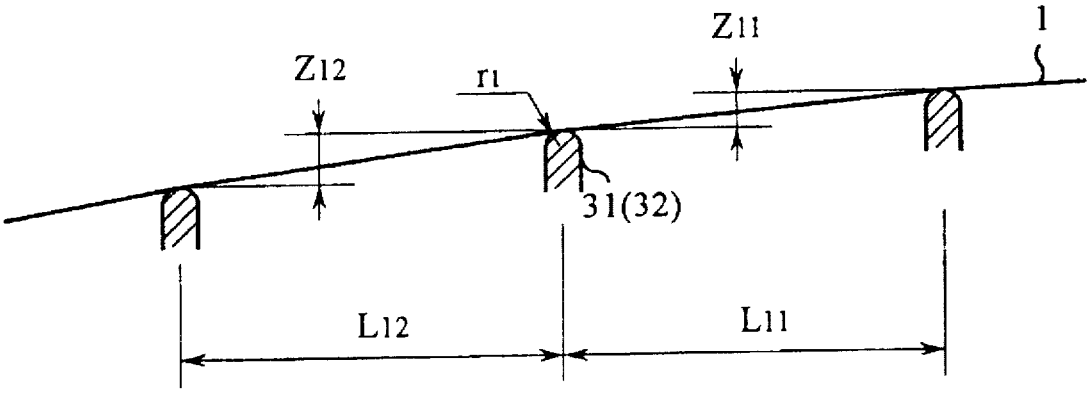
FIG. 2(*a*) is an enlarged fragmentary cross sectional view taken on a plane parallel to the depth direction of a yarn heat channel shown in FIG. 1(*a*) or 1(*b*)
Figure 2B:
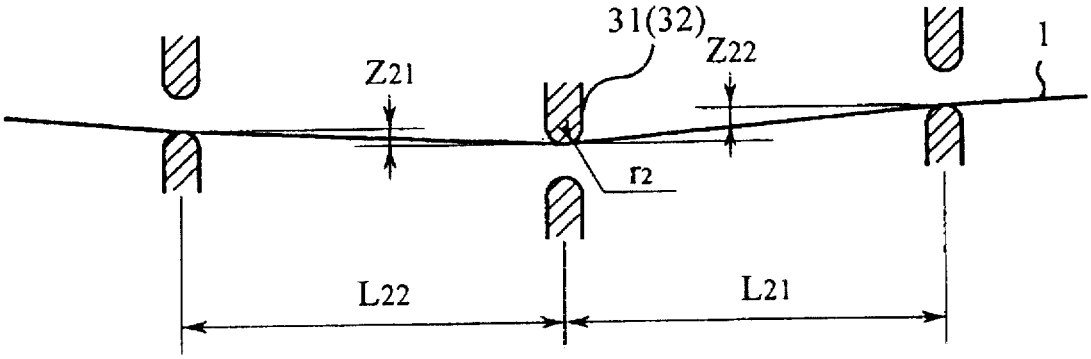

Making the assumption that the yarn travel path of the synthetic fiber yarn 1 extends along only the arched line and that the wall portions of the straight slits 31*a* and 32*a* of the yarn guide members 31 and 32 have cross sections shown in FIG. 2(*a*), the total contact length of the contact surface portions of the synthetic fiber yarn 1 is represented by "S1" defined as follows:

$$S1=r1\cdot\pi/180\cdot\tan^{-1}(Z12/L12)-r1\cdot\pi/180\cdot\tan^{-1}(Z11/L11) \quad (1)$$

wherein "Z11," "Z12," "L11" and "L12" are representative of distances, respectively, shown in FIG. 2(*a*), and r1 is a radius of curvature of each of the wall portions of the straight slits 31*a* and 32*a* brought into contact with the contact surface portions of the synthetic fiber yarn 1.

On the other hand, making the assumption that the yarn travel path of the synthetic fiber yarn 1 extends along only the zigzag line and that the wall portions of the straight slits 31*a* and 32*a* of the yarn guide members 31 and 32 have cross sections, respectively, shown in FIG. 2(*b*), the total contact length of the contact surface portions of the synthetic fiber yarn 1 is represented by "S2" defined as follows:

$$S2=r2\cdot\pi/180\cdot\tan^{-1}(Z22/L22)+r2\cdot\pi/180\cdot\tan^{-1}(Z21/L21) \quad (2)$$

wherein "Z21," "Z22," "L21" and "L22" are representative of distances, respectively, shown in FIG. 2(*b*), and r2 is a radius of curvature of each of the wall portions of the straight slits 31*a* and 32*a* brought into contact with the contact surface portions of the synthetic fiber yarn 1.

<Experiments>

Figure 3:
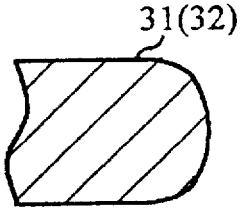
FIG. 3 is a further enlarged fragmentary cross sectional view showing a wall portion of each of the yarn guide members brought into contact with a synthetic fiber yarn.

Experiments are carried out under the condition that the yarn travel path of the synthetic fiber yarn 1 extends along an arched line on an imaginary plane parallel to the depth direction of the yarn heat channel 20*a* and along a zigzag line on another imaginary plane parallel to the width direction of the yarn heat channel 20*a*. The total contact length of the contact surface portions of the synthetic fiber yarn 1 is varied stepwise by changing, in shape, the cross sections of the wall portions of the straight slits 31*a* and 32*a* respectively brought into contact with the contact surface portions of the synthetic fiber yarn 1, and by changing the measurements and the positions of the wall portions of the straight slits 31*a* and 32*a*. In the experiments, are measured up the processing speed at which there occurs the surging phenomenon on the synthetic fiber yarn 1, the dyeing property, and the degree of fluff in quantity. Based on the shape of a cross section shown in FIG. 3, are formed and transformed the wall portions of the straight slits 31*a* and 32*a* brought into contact with the synthetic fiber yarn 1.

Other conditions regarding the experiments are described below. Kind of the synthetic fiber yarn 1: Polyester filament yarn formed by 36 polyester filaments and having a size of 75 deniers.

Ratio of the first yarn heat channel 21*a* to the second heat yarn channel 22*a* in length: 1 to 1.9

Total length (LH) of the yarn heat members 21 and 22: 1.1 m

Temperature applied to the synthetic fiber yarn 1 in the first yarn heat channel 21*a*: 500° C.

Temperature applied to the synthetic fiber yarn 1 in the second yarn heat channel 22*a*: 260° C.

Total number of the yarn guide members 31 and 32 in the first yarn heat channel 21*a*: 11

Total number of the yarn guide members 31 and 32 in the second yarn heat channel 22*a*: 11

Magnification in Drawing: 1.65

Type of False Twisting Machine: Three Axes Friction Disks (Disk constitution: 1-7-1)

The number of experiments is ten and the results of the experiments are as follows:

| Exp. No. | Total Contact Length (mm) | Surging Occurrence Speed (m/min) | Dyeing Property | Fluff Quantity (Spots/kg) |
|---|---|---|---|---|
| 1 | 0.37 | 1160 | x | — |
| 2 | 0.85 | 1218 | x | — |
| 3 | 1.27 | 1290 | x | 0.20 |
| 4 | 1.70 | 1280 | Δ | 0.22 |
| 5 | 2.33 | 1370 | Δ | 0.27 |
| 6 | 3.53 | 1420 | ○ | 0.25 |
| 7 | 10.53 | 1440 | ○ | 0.22 |
| 8 | 11.40 | 1420 | ○ | 0.30 |
| 9 | 20.10 | 1430 | ○ | 0.33 |
| 10 | 43.37 | 1455 | ○ | 1.43 |

x: Bad
Δ: Border-line case
○: Good

In the table, it is noted that the dyeing property is evaluated under the condition that the processing speed is smaller by 100 meters per minute than a processing speed at which there occurs the surging phenomenon on the synthetic fiber yarn 1. It is also noted that the fluff quantity is evaluated under the condition that the winding speed is 1200 meters per minute. In the experiments 1 and 2, since the false twisting machine is unable to process the synthetic fiber yarn 1 at a processing speed of 1200 meters per minute due to the surging, data of fluff quantity cannot be obtained.

It will be apparent from the results of the experiments shown in the table that the dyeing properties in the experiments 1–5 each using a total contact length smaller than 3.53 mm are bad or in border-line case. The results of experiments 1–5 also show that each of the surging occurrence speeds is considerably small. In the meantime, the experiments 6–9 each using a total contact length not less than 3.53 mm show that each of the surging occurrence speeds exceeds 1400 m/min. In the experiments 6–9, is confirmed the fact that there occurs no harmful vibration on the synthetic fiber yarn 1 between the adjoining yarn guide members in the yarn heat channel 20*a*. In addition, is confirmed the fact that dyeing property is good in the experiments 6–9.

In the experiment 10 using the total contact length of 43.37 mm, there occurs lots of fluff and, accordingly, the synthetic fiber yarn 1 is reduced in quality. In the experiments 6–9 using the total contact length not more than 20.10 mm, the quantity of the fluff occurring on the synthetic fiber yarn 1 is not more than 0.33 spots/kg. This means that the synthetic fiber yarn 1 in the experiments 6–9 is good or excellent in quality.

As will be appreciated from the results of the experiments 1–10 and the foregoing explanation, if the total contact length is smaller than 4 mm, the synthetic fiber yarn 1 has dyeing property lacking in uniformity. In addition, the surging occurrence speed, i.e., the processing speed at there occurs a surging phenomenon on the synthetic fiber yarn 1 is relatively low and, as a result, the false twisting machine or the drawing and false twisting machine is unable to process the synthetic fiber yarn 1 at high speed. It is, therefore, proper that the minimum of the total contact length should be 4 mm. If, on the other hand, the total contact length exceeds 20 mm by a large margin, the surging occurrence speed, i.e., the processing speed at there occurs a surging phenomenon on the synthetic fiber yarn 1 is not increased much. In spite of that, there occurs lots of fluff on the synthetic fiber yarn 1 and, consequently, the synthetic fiber yarn 1 is decreased in quality. Hence, it is proper that the maximum of the total contact length should be 20 mm. Preferably, the total contact length may be set to 7 mm.

Since, in the present embodiment, the total contact length representative of a sum of the lengths of the contact surface portions of the synthetic fiber yarn 1 brought into contact with the yarn guide members is not less than 4 mm and not more than 20 mm, the synthetic fiber yarn 1 can be prevented from having dyeing property lacking in uniformity. In addition, lots of fluff can be prevented from occurring on the synthetic fiber yarn 1. As a result, the synthetic fiber yarn 1 can be prevented from decreasing in quality. On the other hand, as a result of setting the total contact length within a range between 4 mm and 20 mm, the processing speed range within which there occurs no surging phenomenon on the synthetic fiber yarn 1 can be extremely increased. This means that the false twisting machine or drawing and false twisting machine is able to process the synthetic fiber yarn 1 at a considerably higher speed.

Referring to FIGS. 5 to 8 of the drawings, a second preferred embodiment of the yarn heating apparatus according to the present invention will be described hereinafter. The second embodiment of the yarn heating apparatus is constructed similarly to the first embodiment, except for a plurality of yarn guide members 51 and a plurality of yarn guide members 52. For this reason, other constitutional elements of the second embodiment are respectively designated by the same reference numerals and symbols as the individual constitutional elements of the first embodiment are done, with the intention of omitting repeated description and illustration thereof.

The yarn guide members 51 and 52 are located in the yarn heat channel 20*a* of the yarn heat member unit 20, i.e., in each of the first yarn heat channel 21*a* of the first yarn heat member 21 and the second yarn heat channel 22*a* of the second yarn heat member 22, in spaced relationship to one another. More specifically, the yarn guide members 51 and 52 are alternately aligned in and along the yarn heat channel 20*a* of the yarn heat member unit 20. The yarn guide members 51 serve as means not only for guiding the synthetic fiber yarn 1 through the yarn heat channel 20*a* of the yarn heat member unit 20 but also for preventing the synthetic fiber yarn 1 from vibrating in the width direction of the yarn heat channel 20*a* of the yarn heat member unit 20. The yarn guide members 52 serve as means not only for guiding the synthetic fiber yarn 1 through the yarn heat channel 20*a* of the yarn heat member unit 20 but also for preventing the synthetic fiber yarn 1 from vibrating in the depth direction of the yarn heat channel 20*a* of the yarn heat member unit 20. The synthetic fiber yarn 1 is bent by each of the yarn guide members 51 and has a plurality of contact surface portions brought into contact with each closed end of straight slits 51*a* which will become apparent as the description proceeds. Although the synthetic fiber yarn 1 is brought into contact with the yarn guide members 52, the synthetic fiber yarn 1 is not bent by each of the yarn guide members 52. Making the assumption that yarn travel path of the synthetic fiber yarn 1 is projected upon an imaginary plane that is parallel to the vertical line in FIG. 5, i.e., the depth direction of the yarn heat channel 20*a* of the yarn heat member unit 20, the yarn travel path of the synthetic fiber yarn 1 is shown in the imaginary plane as extending along an arched line.

Figure 5:
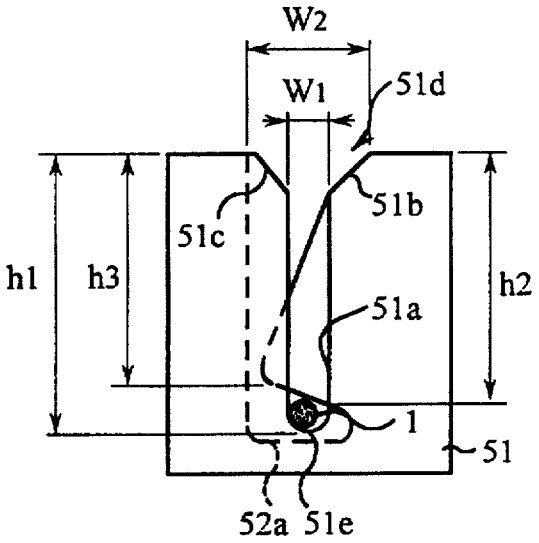
FIG. 5 is a view similar in part to FIG. 1(*b*) but showing a second embodiment of the yarn heating apparatus according to the present invention.

The yarn guide member 51 is shown in FIG. 5 as having, in the vicinity of its own center, a straight slit 51*a* straightly extending in the depth of the yarn heat channel 20*a* of the yarn heat member unit 20. The straight slit 51*a* has a length denoted by "h1" and a width denoted by "w1" in FIG. 5. In addition, the straight slit 51*a* has a closed end 51*e* for bending the synthetic fiber yarn 1 and an open end 51*d* which allows the synthetic fiber yarn 1 to enter and escape from the straight slit 51*a*. The open end 51*d* of the straight slit 51*a* is defined by a pair of slant wall portions 51*b* and 51*c* and, accordingly, the width of the open end 51*d* of the straight slit 51*a* is increased to w2 larger than the foregoing width w1 of the straight slit 51*a*.

Figure 6:
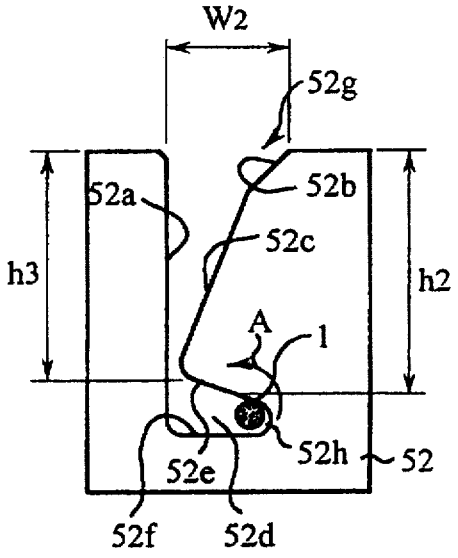
FIG. 6 is a plan view of one of two yarn guide members shown in FIG. 5.

The yarn guide member 52 is shown in FIG. 6 as having, in the vicinity of its own center, a hook-shaped slit 52*a* which has an open end 52*g* allowing the synthetic fiber yarn 1 to enter and escape from the hook-shaped slit 52*a*. The width of the open end 52*g* of the hook-shaped slit 52*a* is equal to the width w2 of the open end 51*d* of the straight slit 51*a* of the yarn guide member 51. The open end 52*g* of the hook-shaped slit 52*a* of the yarn guide member 52 is defined in part by a first slant wall portion 52*b* which has the same angle of inclination as the slant wall portion 51*b* of the yarn guide member 51 does. The first slant wall portion 52*b* is followed by a second slant wall portion 52*c* which has an angle of inclination larger than that of the first slant portion 52*b* with respect to the horizontal line in FIG. 6. The first and second slant wail portions 52*b* and 52*c* serve as deflection means for deflecting the synthetic fiber yarn 1 by a predetermined deflection from the vertical center axis of the yarn guide member 52 toward the left side of the yarn guide member 52 in FIG. 6, when the synthetic fiber yarn 1 is caused to enter the hook-shaped slit 52*a* and to move to a position which is h3 in depth. The second slant wall portion 52*c* is followed by an upper wall portion 52*e* and a lower wall portion 52*f* collectively forming a vertical vibration restraint slit portion 52*d* which is included in the hook-shaped slit 52*a*. When the synthetic fiber yarn 1 is further moved to pass the position which is h3 in depth, the synthetic fiber yarn 1 is escaped, due to its own tension, from the low end of the second slant wail portion 52*c* to enter the vertical vibration restraint slit portion 52*d*. At the same time, the synthetic fiber yarn 1 is returned from the deflection position to the first position which is in the vicinity of the vertical center line of the yarn guide member 52 in FIG. 6. When the synthetic fiber yarn 1 enters not only the straight slits 51 but also the vertical vibration restraint slit portion 52*d* of the hook-shaped slit 52, the synthetic fiber yarn 1 is prevented by the yarn guide members 51 from vibrating in the horizontal direction in FIG. 5 or 6, i.e., in the width direction of the yarn heat channel 20*a* and by the yarn guide members 52 from vibrating in the vertical direction in FIG. 5 or 6, i.e., in the depth direction of the yarn heat channel 20*a*.

Figure 7:
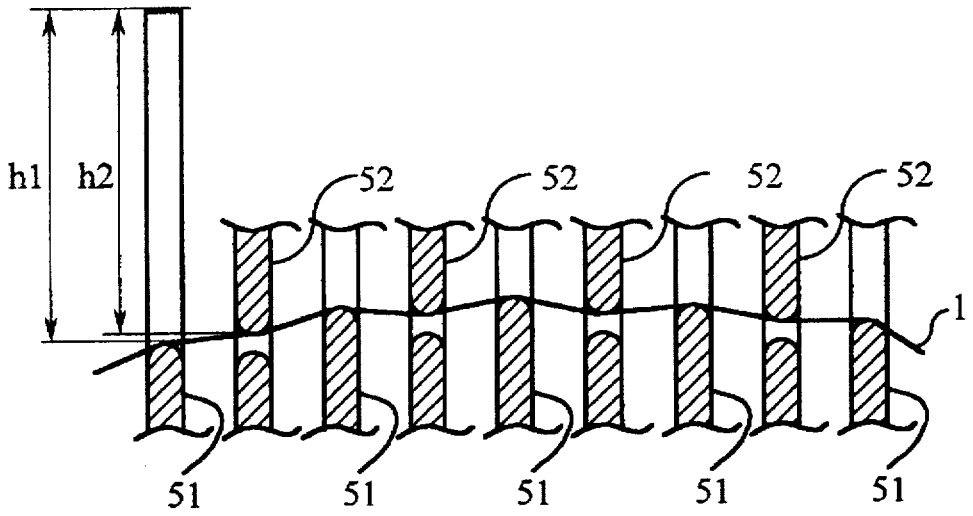
FIG. 7 is a fragmentary cross sectional view showing an example of a yarn travel path defined by the yarn guide members shown in FIGS. 5 and 6.
Figure 8:
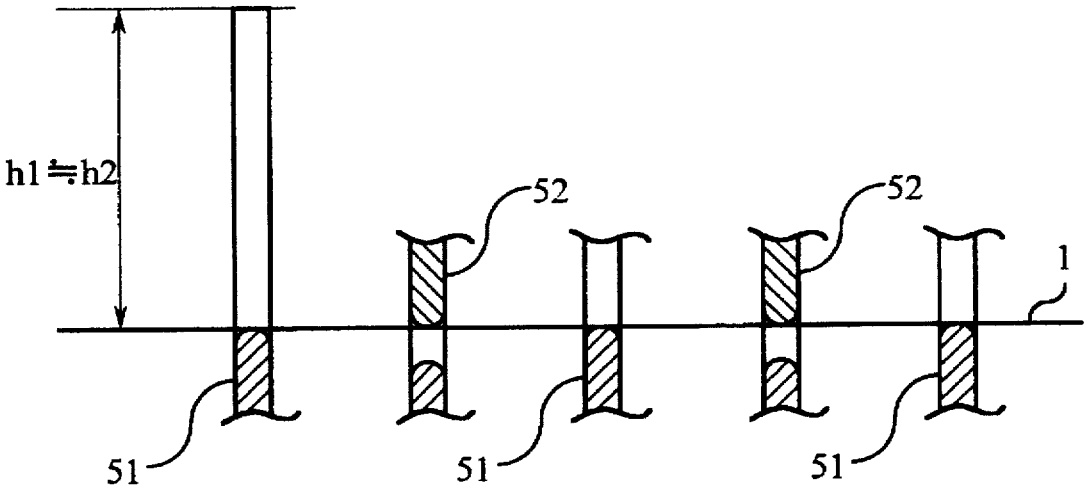
FIG. 8 is a fragmentary cross sectional view showing another example of the yarn travel path defined by the yarn guide members shown in FIGS. 5 and 6.

As described hereinbefore, the yarn travel path of the synthetic fiber yarn 1 in the yarn heat channel 20*a* is shown in the imaginary plane parallel to the vertical line in FIG. 5 or 6 as extending along an ached line but, if desired, may be modified by changing the depths h1 and h2 shown in FIGS. 5 and 6. The depth h1 is indicative of a position of the closed end 51*e* of the straight slit 51*a* of the yarn guide member 51, while the depth h2 is indicative of a position of the upper wall portion 52*e* of the hook-shaped slit 52*a* of the yarn guide member 52. FIG. 7 shows a first example of the modified yarn travel path. In FIG. 7, the yarn travel path of the synthetic fiber yarn 1 in the yarn heat channel 20*a* is shown in the same imaginary plane as not only extending, on the whole, along an arched line but also extending locally along a zigzag line. FIG. 8 shows a second example of the modified yarn travel path. In FIG. 8, the yarn travel path of the synthetic fiber yarn lin the yarn heat channel 20*a* is shown in the imaginary plane as extending along a straight line.

As will be appreciated from the foregoing description, the synthetic fiber yarn 1 can be prevented by the yarn guide members 51 and 52 from vibrating in the depth direction of the yarn heat channel 20*a* as well as in the width direction of the yarn heat channel 20*a*, thereby making it possible to prevent harmful vibrations from occurring on the synthetic fiber yarn 1 and to prevent the synthetic fiber yarn 1 from being flourished.

In addition, ail of the yarn guide members 52 are set in the yarn heat channel 20*a* of the yarn heat member unit 20 so as to direct their own closed ends of the hook-shaped slits 52*a* toward the same side wall of the yarn heat channel 20*a* of the yarn heat member unit 20. In other words, all of the vertical vibration restraint slit portions 52*d* of the hook-shaped slits 52*a* extend in the same direction from the lower end of the second slant wall portions 52*c* to the closed ends of the hook-shaped slits 52*a*, respectively. If, therefore, the synthetic fiber yarn 1 is only moved in the same direction, i.e., leftward in FIG. 6, the synthetic fiber yarn 1 can be escaped from all of the vertical vibration restraint slit portions 52*d* of the hook-shaped slits 52 with ease.

Furthermore, the surface of the upper wall portion 52*e* of the hook-shaped slit 52*a* slants with respect to the horizontal line in FIG. 6, i.e., the bottom wall surface of the yarn heat channel 20*a* of the yarn heat member unit 20 to approach the bottom wall surface of the yarn heat channel 20*a* at the closed end 52*h* of the hook-shaped slit 52*a*. The synthetic fiber yarn 1 is twisted by the yarn false twist apparatus in a predetermined rotational direction so as to move toward the closed end 52*h* of each of the hook-shaped slits 52*a* due to friction between the synthetic fiber yarn 1 and the upper wall portion 52*e* of the hook-shaped slit 52*a* at a time when the twisted synthetic fiber yarn 1 is brought into contact with the upper wall portion 52*e* of the hook-shaped slit 52*a*. In the predetermine rotational direction is shown by an arrow "A" in FIG. 6. By twisting the synthetic fiber yarn 1 in the predetermined rotational direction, the synthetic fiber yarn 1 can be prevented from escaping from the vertical vibration restraint slit portions 52*d* of the hook-shaped slits 52 during the false twisting process.

Figure 9:
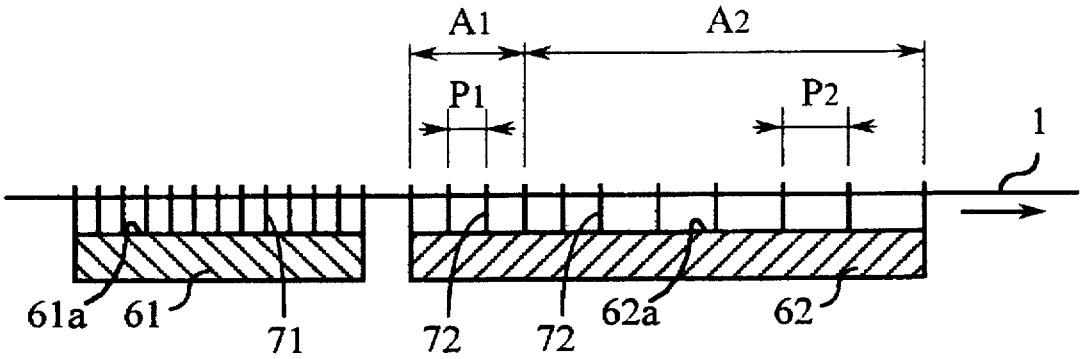
FIG. 9 is a cross sectional view of a third embodiment of the yarn heating apparatus according to the present invention.

Referring to FIG. 9 of the drawings, a third preferred embodiment of the yarn heating apparatus according to the present invention will be described hereinafter. The yarn heating apparatus is shown in FIG. 9 as comprising a first yarn heat member 61 formed with a yarn heat channel 61*a* partially defining in part the twist existence path section for heating the synthetic fiber yarn 1 passing through the yarn heat channel 61*a* of the first yarn heat member 61 and a plurality of first yarn guide members 71 aligned at space intervals in the yarn heat channel 61*a* of the first yarn heat member 61 for guiding the synthetic fiber yarn 1 through the yarn heat channel 61*a* of the first yarn heat member 61. The yarn heating apparatus further comprises a second yarn heat member 62 formed with a yarn heat channel 62*a* partially defining in part the twist existence path section for heating the synthetic fiber yarn 1 passing through the yarn heat channel 62*a* of the second yarn heat member 62, and a plurality of second yarn guide members 72 aligned at space intervals in the yarn heat channel 62*a* of the second yarn heat member 62 for guiding the synthetic fiber yarn 1 through the yarn heat channel 62*a* of the second yarn heat member 62. The second yarn heat member 62 is positioned downstream of the first yarn heat member 61.

The second yarn heat member 62 is divided into two heat sections aligned along the yarn heat channel 62*a* of the second yarn heat member 62. The two heat sections consist of a first heat section A1 and a second heat section A2 positioned downstream of the first heat section A1. The largest one of the space intervals P1 between the second yarn guide members 72 in the first heat section A1 of the yarn heat channel 62*a* is smaller than the smallest one of the space intervals P2 between the second yarn guide members 72 in the second heat section A2 of the yarn heat channel 62*a*.

The space interval P1 between adjoining two of the second yarn guide members 72 in the first heat section A1 becomes larger as the adjoining two of the second yarn guide members 72 in the first heat section A1 are positioned more downstream. Likewise, the space interval P2 between adjoining two of the second yarn guide members 72 in the second heat section A2 becomes larger as the adjoining two of the second yarn guide members 72 in the second heat section A2 are positioned more downstream. If, however, desired, the space intervals P1 may be equal to one another. Similarly, the space intervals P2 may be equal to one another. In the present embodiment, the first yarn guide members 71 are aligned in the yarn heat channel 61*a* at regular intervals each smaller than the smallest one of the spaced intervals P1 between the second yarn guide members 72 in the first section A1 of the yarn heat channel 62*a*.

Since the space intervals P1 and P2 are thus determined, the harmful vibration can be prevented from occurring on the synthetic fiber yarn 1 in the intermediate zone of the twist existence path section of the yarn travel path, thereby making it possible to hold, at a stable state, the temperature of the synthetic fiber yarn 1 in the downstream side zone of the twist existence path section of the yarn travel path. This means that the temperature of the synthetic fiber yarn 1 at the downstream end of the yarn heat channel 62*a* can be held at a constant level and, accordingly, that the false twisting process can be carried out under preferable temperature.

In addition, the third embodiment of the yarn heating apparatus is suitable for a false twisting machine or a drawing and false twisting, machine in which the temperature applied to the synthetic fiber yarn 1 in the yarn heat channel 61*a* is roughly equal to or smaller than that in the yarn heat channel 62*a* or in which only the second yarn heat member 62 is in operation, i.e., only the first yarn heat member 61 is out of operation.

The many features and advantages of the invention are apparent from the detailed specification and thus it is intended by the appended claims to cover all such features and advantages of the invention which fall within the true spirit and scope thereof. Further, since numerous modifications and changes will readily occur to those skilled in the art, it is not desired to limit the invention to the exact construction and operation illustrated and described, and accordingly, all suitable modifications and equivalents may be resorted to, falling with the scope of the invention.

What is claimed is:

1. A yarn heating apparatus, interposed between a false twist apparatus imparting twist to a synthetic fiber yarn and a yarn feed apparatus feeding said synthetic fiber yarn to said false twist apparatus, for heating said synthetic fiber yarn traveling on a yarn travel path extending from said yarn feed apparatus to said false twist apparatus, said yarn travel path including a twist existence path section through which the twist imparted to said synthetic fiber yarn extends continuously, comprising:

a yarn heat member unit formed with a yarn heat channel defining in part said twist existence path section of said yarn travel path for heating said synthetic fiber yarn passing through said yarn heat channel; and a plurality of yarn guide members located in said yarn heat channel of said yarn heat member unit in spaced relationship to one another for guiding said synthetic fiber yarn through said yarn heat channel of said yarn heat member unit, said synthetic fiber yarn in said yarn heat channel being bent by each of said yarn guide members and having a plurality of contact surface portions each brought into contact with each of said yarn guide members, said contact surface portions of said synthetic fiber yarn having lengths, respectively, measured along said yarn travel path, and the lengths of said contact surface portions of said synthetic fiber yarn amounting to a total contact length which is not less than 4 mm and not more than 20 mm.

2. A yarn heating apparatus, interposed between a false twist apparatus imparting twist to a synthetic fiber yarn and a yarn feed apparatus feeding said synthetic fiber yarn to said false twist apparatus, for heating said synthetic fiber yarn traveling on a yarn travel path extending from said yarn feed apparatus to said false twist apparatus, said yarn travel path including a twist existence path section through which the twist imparted to said synthetic fiber yarn extends continuously, comprising:

a yarn heat member formed with a yarn heat channel defining in part said twist existence path section of said yarn travel path for heating said synthetic fiber yarn passing through said yarn heat channel; and a plurality of yarn guide members located in said yarn heat channel of said yarn heat member in spaced relationship to one another for guiding said synthetic fiber yarn through said yarn heat channel of said yarn heat member, said yarn guide members being classified into two groups consisting of a first guide member group formed by the yarn guide members which prevent the synthetic fiber yarn from vibrating in a width direction of said yarn heat channel of said yarn heat member, and a second guide member group formed by the yarn guide members which prevent said synthetic fiber yarn from vibrating in a depth direction of said yarn heat channel of said yarn heat member.

3. A yarn heating apparatus, interposed between a false twist apparatus imparting twist to a synthetic fiber yarn and a yarn feed apparatus feeding said synthetic fiber yarn to said false twist apparatus, for heating said synthetic fiber yarn traveling on a yarn travel path extending from said yarn feed apparatus to said false twist apparatus, said yarn travel path including a twist existence path section through which the twist imparted to said synthetic fiber yarn extends continuously, comprising:

a first yarn heat member formed with a yarn heat channel defining in part said twist existence path section of said yarn travel path for heating said synthetic fiber yarn passing through said yarn heat channel of said first yarn heat member;

a plurality of first yarn guide members aligned at space intervals in said yarn heat channel of said first yarn heat member for guiding said synthetic fiber yarn through said yarn heat channel of said first yarn heat member;

a second yarn heat member formed with a yarn heat channel defining in part said twist existence path section of said yarn travel path for heating said synthetic fiber yarn passing through said yarn heat channel of said second yarn heat member, said second yarn heat member being positioned downstream of said first yarn heat member; and a plurality of second yarn guide members aligned at space intervals in said yarn heat channel of said second yarn heat member for guiding said synthetic fiber yarn through said yarn heat channel of said second yarn heat member, said second yarn heat member being divided into at least two yarn heat sections aligned along said yarn travel path, said two yarn heat sections consisting of a first yarn heat section and a second yarn heat section positioned downstream of said first yarn heat section, and the largest one of the space intervals at which said second yarn guide members are aligned in said first yarn heat section being smaller than the smallest one of the space intervals at which said second yarn guide members are aligned in said second yarn heat section.

* * * * *